US006557793B2

(12) United States Patent
Nakazawa et al.

(10) Patent No.: US 6,557,793 B2
(45) Date of Patent: May 6, 2003

(54) TOROIDAL CORE WINDING METHOD AND AUTOMATIC WINDING APPARATUS

(75) Inventors: Masaru Nakazawa, Ueda (JP); Takashi Kawamura, Ueda (JP); Masayasu Shimaru, Ueda (JP)

(73) Assignee: Harmonic Drive Systems, Inc., Tokyo (JP)

( * ) Notice: Subject to any disclaimer, the term of this patent is extended or adjusted under 35 U.S.C. 154(b) by 95 days.

(21) Appl. No.: 09/935,551

(22) Filed: Aug. 24, 2001

(65) Prior Publication Data

US 2003/0038204 A1 Feb. 27, 2003

(51) Int. Cl.[7] ..... B65H 81/02

(52) U.S. Cl. ..... 242/434.5; 242/434.7; 29/605

(58) Field of Search ..... 242/434, 434.5, 242/434.7; 29/605

(56) References Cited

U.S. PATENT DOCUMENTS 1,382,403 A * 6/1921 Angier et al. ..... 242/521
3,132,816 A * 5/1964 Oshima ..... 242/434.7
3,458,146 A * 7/1969 Warner ..... 242/434.5
4,379,527 A * 4/1983 Albo et al. ..... 242/434.5
4,529,138 A * 7/1985 Perschka ..... 242/434.7
5,282,580 A * 2/1994 Kent ..... 242/434.1
6,145,774 A * 11/2000 Courtney et al. ..... 242/434.7

FOREIGN PATENT DOCUMENTS

JP 6-342730 12/1994

* cited by examiner

*Primary Examiner*—Emmanuel Marcelo
(74) *Attorney, Agent, or Firm*—Burns, Doane, Swecker & Mathis, L.L.P.

(57) ABSTRACT

A toroidal core automatic winding apparatus has a winding ring positioned concentrically around a supply ring. The rings are C-shaped, by virtue of a through-slit on each ring. Wire wound on the supply ring is drawn out towards a toroidal core, via a wire guide on the winding ring. A ring rotation mechanism rotates the supply ring and winding ring in the same direction as that in which the supply ring was rotated when being loaded with the wire, but at mutually different speeds, to wind the wire around the toroidal core. The difference in the rotation amounts of the supply ring and winding ring equals the length of the wire that is wound on the toroidal core.

15 Claims, 13 Drawing Sheets

(Prior Art)

(Prior Art)

TOROIDAL CORE WINDING METHOD AND AUTOMATIC WINDING APPARATUS

BACKGROUND OF THE INVENTION

1. Field of the Invention

The present invention relates to an automatic toroidal core winding apparatus able to wind toroidal coils by winding wire in a spiral on a toroidal core. The invention particularly relates to an automatic toroidal core winding apparatus that can wind wire on a toroidal core while minimizing the load on the coil and maintaining the wire at a constant tension.

2. Related Art Description

FIGS. 15, 16, 17 and 18 illustrate the principle of winding coil wire on a toroidal core using a supply ring and winding ring. A supply ring 71 and winding ring 72 are provided with pullout or open/close type ring openings 74 and 75 to enable the toroidal core 73 to be arranged with the rings 71 and 72 passing through the center hole of the core 73. In the prior art the openings 74 and 75 are opened manually and the toroidal core 73 is passed through the openings so that each ring passes to the center hole 73*a* of the core, with the central axis 73*b* of the toroidal core 73 at right-angles to the central axis 70 of the rings.

The supply ring 71 has a U-shaped groove 71*c* around its circumference. In order to enable wire 9 to be wound onto the groove 71*c*, the end of the wire 9 is manually attached to a hook (not shown) on the supply ring 71. The winding ring 72 has substantially the same diameter as the supply ring 71, with which it is aligned concentrically. The supply ring 71 has a wire guide 76 via which wire 9 is drawn from the supply ring 71 and a guide roller 77 to guide the wire 9.

In an actual winding operation, first the toroidal core 73 is manually inserted onto the rings 71 and 72 via the openings 74 and 75 to position the core 73 as shown in FIG. 16. The end of the wire 9 is then attached to the supply ring 71 and the supply ring 71 is rotated around its central axis to wind the required amount of wire into the groove 71*c*. After cutting the trailing end of the wire 9, the cut end is passed through the wire guide 76 and around the guide roller 77, and is drawn radially outwards from between the rings and affixed to a retainer means or the like (not shown) provided on the periphery of the toroidal core 73. In this state, the wire wound around the supply ring 71 is spirally wound a required number of turns around the toroidal core 73, and the wire left over on the supply ring 71 is manually removed. Finally, the toroidal core wound with the wire, that is, the toroidal coil, is removed.

As shown by FIG. 17, when the toroidal core is being wound, a drive (not shown) is used to rotate the supply ring 71 and winding ring 72 in the opposite direction from that used to load the wire 9 onto the supply ring 71, and the wire 9 is drawn from the supply ring 71 through the wire guide 76 and guide roller 77 on the winding ring 72 and attached to the toroidal core 73. At this time, the wire 9 is subjected to a prescribed tension imparted by the frictional force between the supply ring 71 and the supply ring 71's support surface (not shown). This tension is for preventing the wire 9 coming off the supply ring 71. As can be seen in FIG. 18, the passage of the guide roller 77 through the center hole 73*a* of the toroidal core 73 subjects the wire 9 to an extreme degree of bending, imposing a large load on the wire 9. This limits the runout of the wire 9, so that the wire 9 is wound around the toroidal core 73 with no slack.

Thus, much of the winding procedure in the case of this type of prior art toroidal core winding apparatus is performed manually, so the productivity is low, and reliability is also a problem. From the standpoint of quality and cost, this has created a strong demand for automation of the winding procedure.

Moreover, since tension is imparted to the wire 9 by frictional force between the supply ring and the ring support surface, any fluctuations in the inertial force of the winding ring during winding acts directly on the wire 9, in addition to which the wire 9 is subjected to a large load when the guide roller passes through the core hole 73*a*. This can make it impossible to maintain the wire 9 at a constant tension, leading to a large difference between the winding force on the inner and outer surfaces of the toroidal core. In some cases, there is a risk that this will damage the insulation or break the wire.

Japanese Patent Laid-Open Publication No. Hei 6-342730 describes a method of suppressing insulation damage and the like by increasing the diameter of the guide roller. However, the size of the guide roller is limited by the size of the center hole in the toroidal core 73 through which the roller must pass. Moreover, as shown in FIG. 18, the center of the winding portion of the toroidal core 73 is offset by a distance E from the central axis of the winding ring 72. Because of this, with the rotation of the winding ring 72, the distance between the wire supply position, as defined by the guide roller 77, and the winding portion of the toroidal core 73 is constantly changing. During each rotation used to wind the wire onto the core, this gives rise to a region R1 at which the wire 9 is pulled taut and a region R2 at which the wire 9 is slack. This lowers the alignment degree of windings, making it impossible to achieve a high-density winding.

SUMMARY OF THE INVENTION

In view of the above drawbacks of the prior art, an object of the present invention is to provide an automatic winding apparatus that automates the winding of a toroidal core.

An object of the present invention is also to provide a method of winding a toroidal core that enables a toroidal core to be wound with a high degree of alignment, enabling wire to be wound at a high density.

To achieve the above object, the present invention provides a method of winding a toroidal core, comprising the steps of arranging a toroidal core on a wire supply ring and a winding ring that are concentrically arranged, with the supply ring and winding ring passing through a central hole of the toroidal core, taking an end of a wire wound circumferentially around an outer peripheral surface of the supply ring and drawing the end of the wire through a wire guide attached to the winding ring, rotating the supply ring and winding ring around central axes of the rings in a same direction as that in which the supply ring was rotated when being loaded with the wire, at mutually different speeds, rotating the toroidal core about its central axis simultaneously with the rotation of the supply ring and winding ring, and spirally winding the toroidal core with a length of the wire that corresponds to the difference in rotation amounts of the supply ring and winding ring.

The above object is also attained by providing an automatic winding apparatus for automatically winding a toroidal core, comprising a supply ring on a peripheral surface of which wire is circumferentially wound, a winding ring having a wire guide for drawing the wire from the supply ring, a toroidal core rotation means that supports the toroidal core so that the supply ring and winding ring pass through a central hole of the toroidal core and also rotates the toroidal core about its central axis, a ring rotation means that rotates the supply ring and winding ring around the rings' central axes in a same direction as that in which the supply ring was rotated when being loaded with the wire, at mutually different speeds, the difference in rotation amounts of the supply ring and winding ring becoming length of wire that is wound on the toroidal core.

It is preferable for the supply ring and winding ring to each be formed in the shape of a C by a slit of a prescribed width provided on the periphery of the rings. The slits can be used to align the rings, facilitating mounting and demounting of cores and the removal of wire.

It is also preferable for the supply ring to be disposed concentrically with the winding ring with the supply ring on the radially inner side of the winding ring, since this makes it possible to prevent the wire coming off the supply ring.

To suppress deformation of C-shaped supply and winding rings, it is also preferable to provide the winding ring with an outer support frame that supports the ring in a way that allows the outer peripheral surface of the ring to freely slide circumferentially. For the same purpose, it is preferable to provide the supply ring with an inner support frame that supports the ring in a way that allows the inner peripheral surface of the ring to freely slide circumferentially.

To enable the end of the wire to be easily fixed to the supply ring, is it preferable to provide the periphery of the supply ring with a wire holder to hold the end of the wire when the wire is being wound onto the supply ring. This can be a resilient strip the resiliency of which is utilized to clamp the end of the wire.

The winding ring can include a wire feed-out hole that runs through from the inside to the outside of the ring, a wire feed-out groove that extends from the outside edge of the wire feed-out hole to one of the edges of the winding ring, and the guide roller mentioned above, located adjacent to the wire feed-out groove.

In this case, it is also preferable to be able to measure the tension of the wire being pulled through the wire feed-out hole and along the feed-out groove, by providing the wire feed-out hole with a tension sensor. It is also preferable to provide a control means that uses the output from the tension sensor for controlling the differential rotation drive so that the wire tension remains constant.

The ring rotation mechanism can include a plurality of winding ring drive rollers and a plurality of supply ring drive rollers, the winding ring drive rollers being spaced at equal intervals around the winding ring in contact with the outer peripheral surface of the ring, forming a circle that is concentric with the ring. Similarly, the supply ring drive rollers are spaced at equal intervals around the supply ring in contact with the outer peripheral surface of the ring, forming a circle that is concentric with the ring.

In this case, it is also preferable to be able to measure the load torque acting on the supply ring drive rollers by providing a torque sensor and a control means that uses the output from the torque sensor for controlling the differential rotation drive so that the load torque remains constant.

It is also preferable for the wire guide to be a kink prevention means that utilizes force balancing based on the wire tension. The kink prevention means can comprise a pair of guide rollers and a support plate that rotatably supports the guide rollers and is rotatably attached to an edge surface of the winding ring, with the centers of rotation of the guide rollers and support plate being parallel to the axis of rotation of the winding ring.

To ensure that the toroidal core is properly supported and rotated, it is also preferable for the toroidal core rotation mechanism to include at least two drive units, with each drive unit having at least three rollers and a drive belt on the rollers, the toroidal core being held by a prescribed force between the drive belts of the drive units, in which state the toroidal core is rotated by the drive belts.

Further features of the invention, its nature and various advantages will be more apparent from the accompanying drawings and following detailed description of the invention.

DETAILED DESCRIPTION OF THE PREFERRED EMBODIMENT

Embodiments of the toroidal core automatic winding apparatus according to the present invention will now be described with reference to the drawings.

Figure 1:
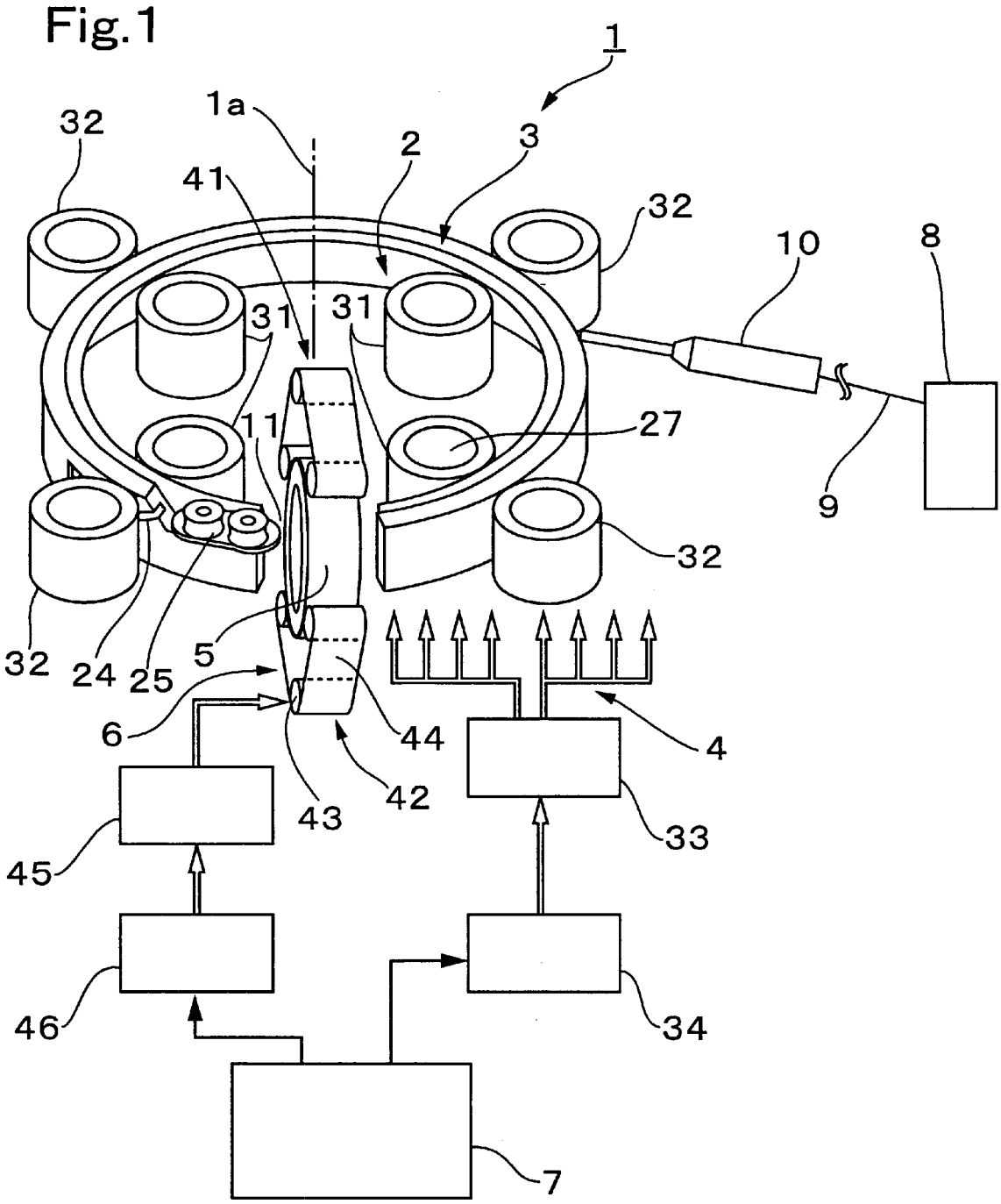
FIG. 1 shows the main parts of a toroidal core automatic winding apparatus that applies the present invention.
Figure 2:
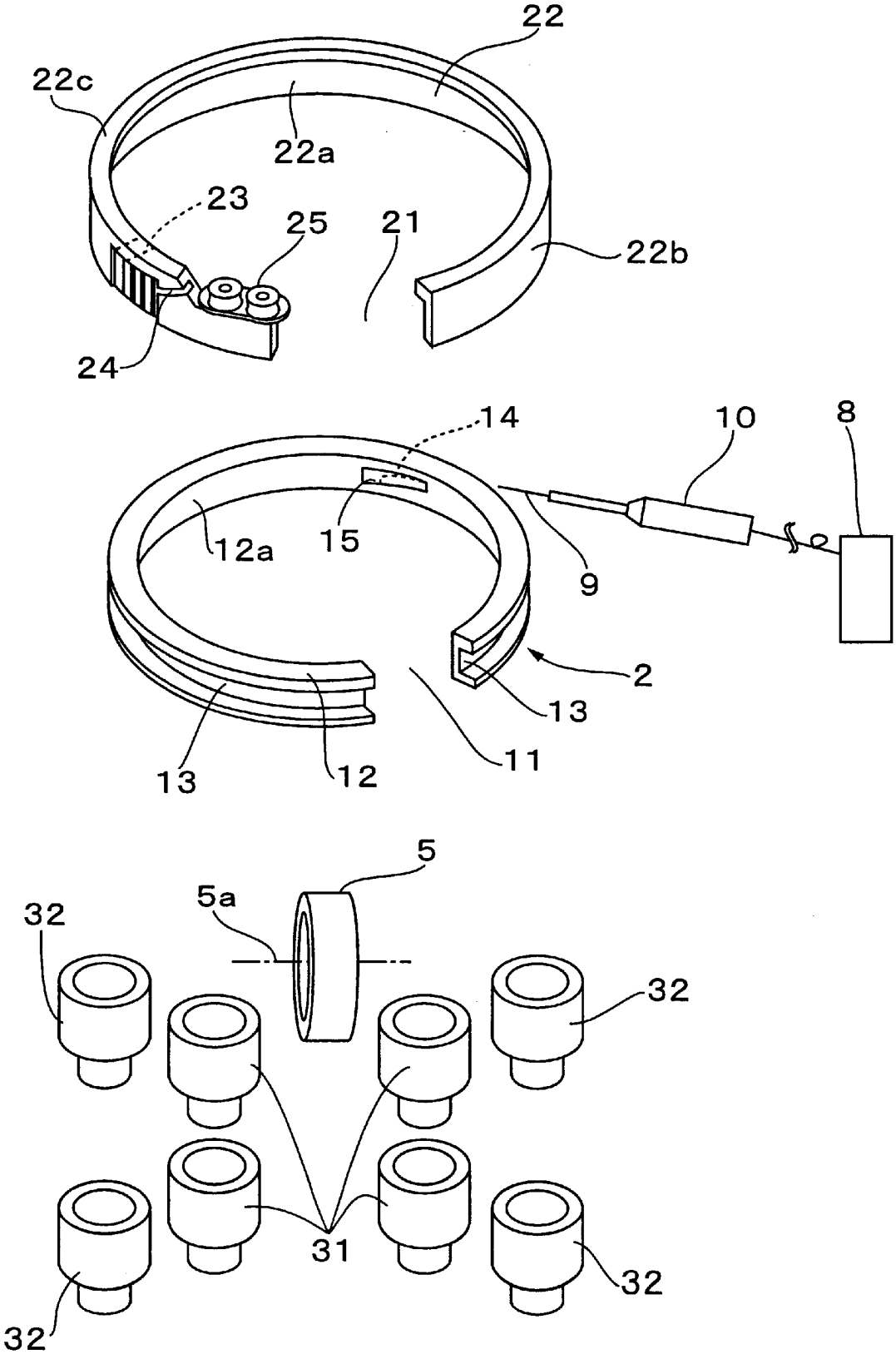
FIG. 2 is a disassembled perspective view of the apparatus of FIG. 1.

FIG. 1 shows the main parts of a toroidal core automatic winding apparatus (winder) according to the present invention, and FIG. 2 is a disassembled perspective view of the apparatus. In this embodiment, the automatic winder 1 includes a supply ring 2, a winding ring 3, a ring rotation mechanism 4 for independently driving each ring, a toroidal core rotation mechanism 6 for rotating a toroidal core 5, and a control unit 7 for controlling the rotation mechanisms 4 and 6.

The supply ring 2 comprises a ring body 12 that is shaped like a C by means of a slit 11, and a U-shaped winding groove 13 disposed around the periphery of the ring body 12 with the open end outwards. The ring body 12 has a through-hole 14 that runs from the inner surface 12*a* to the outer surface 12*b* (the floor of the winding groove 13). A resilient member 15 is provided on the inner surface 12*a,* at the inner end of the through-hole 14. This resilient member 15 is used to hold the end of the wire 9.

The winding ring 3 comprises a ring body 22 that is shaped like a C by means of a slit 21, a wire feed-out hole 23 that runs from the inner surface 22*a* to the outer surface 22*b,* a wire feed-out groove 24 that extends from the outer end of the feed-out hole 23 to an edge 22*c* of the winding ring 22, and a wire guide 25 located adjacent to the groove 24 in the ring edge 22*c*.

The winding ring 3 has an inside diameter that allows the winding ring 3 to be inserted into the supply ring 2. FIG. 1 shows the supply ring 2 positioned concentrically in the winding ring 3, whereby the winding groove 13 is closed off by the inner surface 22*a* of the winding ring 3.

The ring rotation mechanism 4 used to independently rotate the supply ring 2 and winding ring 3 includes a plurality of supply ring drive rollers 31 and a plurality of winding ring drive rollers 32. In this example, there are four drive rollers 31 and four drive rollers 32. The four supply ring drive rollers 31 are arranged at 90-degree intervals around the inner surface 12*a* of the supply ring 2, against which rollers press. Similarly, the winding ring drive rollers 32 are arranged at 90-degree intervals around the outer surface 22*b* of the winding ring 3, against which the rollers press.

The rollers 31 and 32 are driven by a ring drive motor 34, via a differential reduction gear 33. The ring drive motor 34 is controlled by a control unit 7. The supply ring 2 and winding ring 3 are driven to rotate at different speeds about the same axis of rotation 1*a*.

The toroidal core rotation mechanism 6 includes two drive units 41 and 42 located at a specified point along the rings 2 and 3, with one drive above the rings and the other below. Each of the drive units 41 and 42 has a set of three drive rollers 43, and a drive belt 44 around each set of rollers. One of each of the rollers of the drive units 41 and 42 is driven by a toroidal core motor 46 via a reduction gear 45. The motor 46 is controlled by the control unit 7.

As described hereinbelow, a toroidal core 5 is maintained between the drive belts 44 by a prescribed force. In this state, the toroidal core 5 is rotated about its axis of rotation 5*a* by the belts 44.

The supply ring 2 is supplied with wire 9 from a supply source 8. When the wire 9 is fine wire, as shown in the drawing, it should first be threaded through a supply tube 10 to prevent kinks in the wire 9.

The winding operation using the automatic winder 1 of this embodiment will now be explained. First, with reference to FIG. 1, the supply ring 2 and winding ring 3 are rotated to line up the slits 11 and 21 and position the slits between the drive units 41 and 42. This enables the toroidal core 5 to be mounted between the drive units 41 and 42.

Figure 3B:
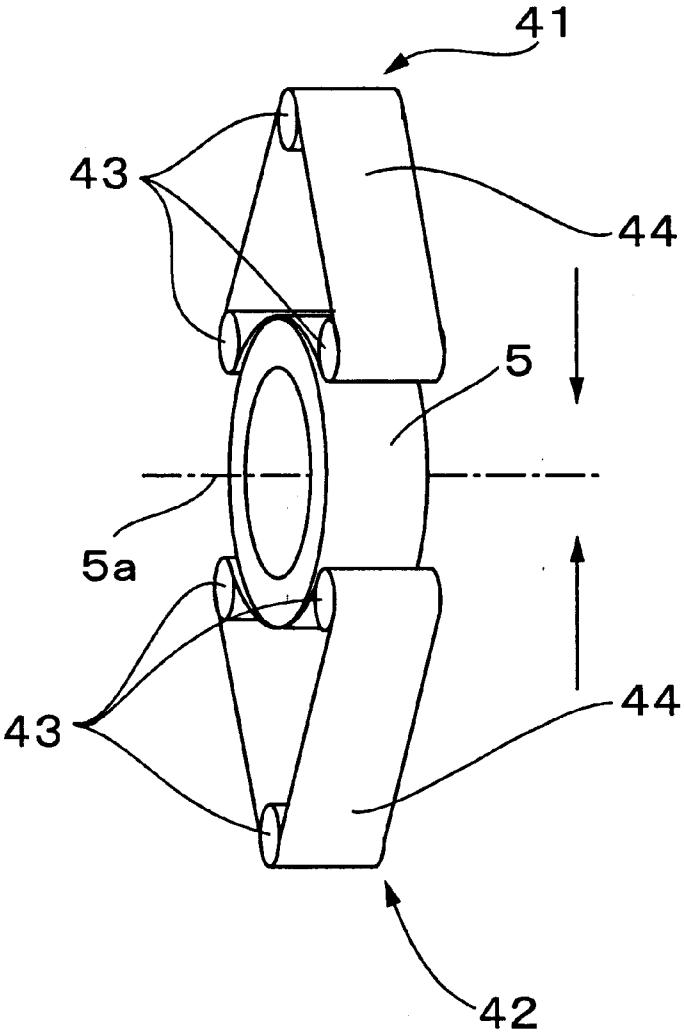
FIGS. 3A and 3B illustrate the operation of the toroidal core rotation mechanism in the automatic winding apparatus of FIG. 1.
Figure 3A:
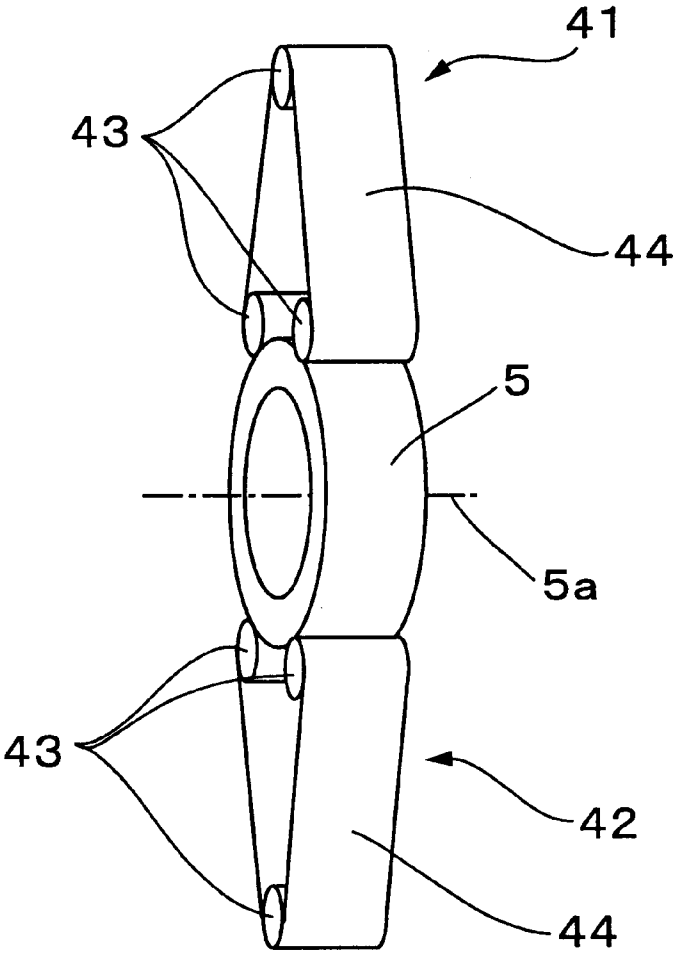

FIGS. 3A and 3B illustrate the operation of the toroidal core rotation mechanism 6 used in the automatic winding apparatus 1. Drive units 41 and 42 can be moved closer together by controlling a moving mechanism that is not shown. When the toroidal core 5 is inserted into the slits 11 and 21 and the drive units 41 and 42 are moved towards each other, the toroidal core 5 is sandwiched between the upper and lower drive belts 44. As a result, the toroidal core 5 is held with its axis of rotation 5*a* in the target location and direction. To rotate the toroidal core 5, the drive units 41 and 42 are brought closer together, as shown in FIG. 3B. In this state, the left and right rollers of the drive units 41 and 42 expand outwards, increasing the area of contact between each belt 44 and the toroidal core 5. This enables the toroidal core 5 to be securely rotated about its axis 5*a* by the belts 44, without any slipping.

Figure 4:
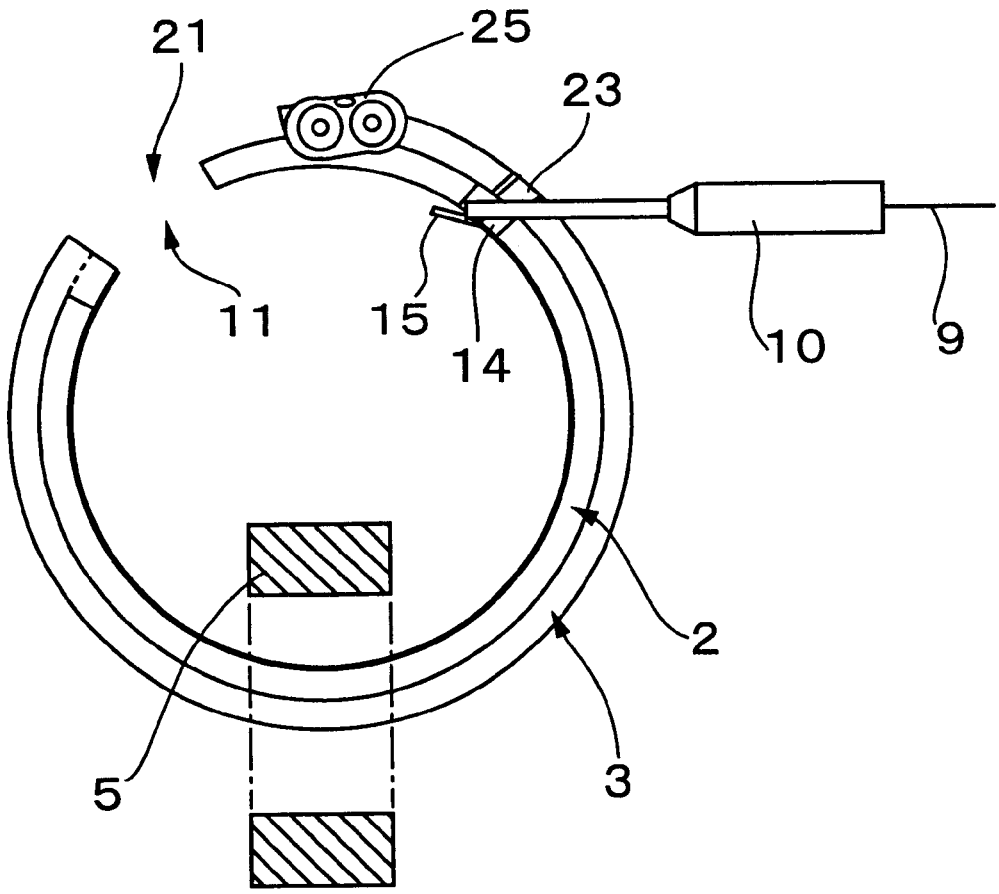
FIG. 4 illustrates the operation of fixing the wire on the supply ring in the apparatus of FIG. 1.
Figure 5A:
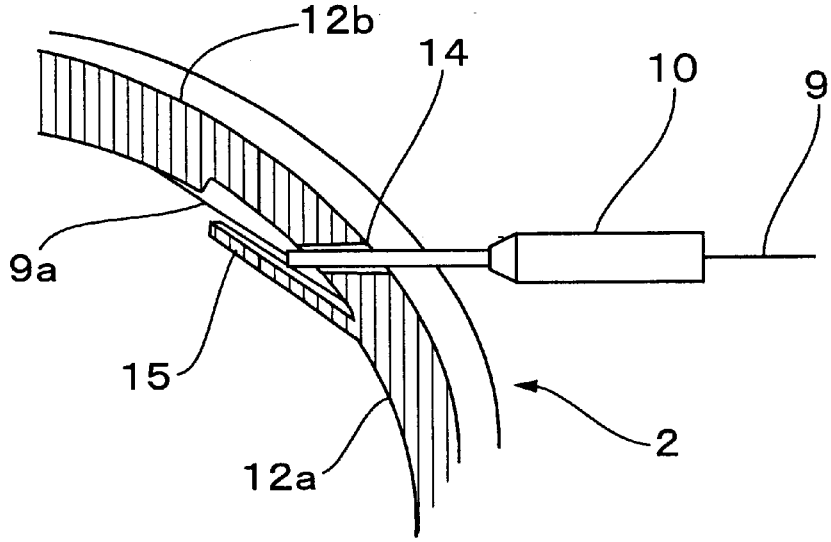
FIGS. 5A and 5B show a cross-section of the supply ring and an enlarged view of a supply tube, during the fixing of the wire.
Figure 5B:
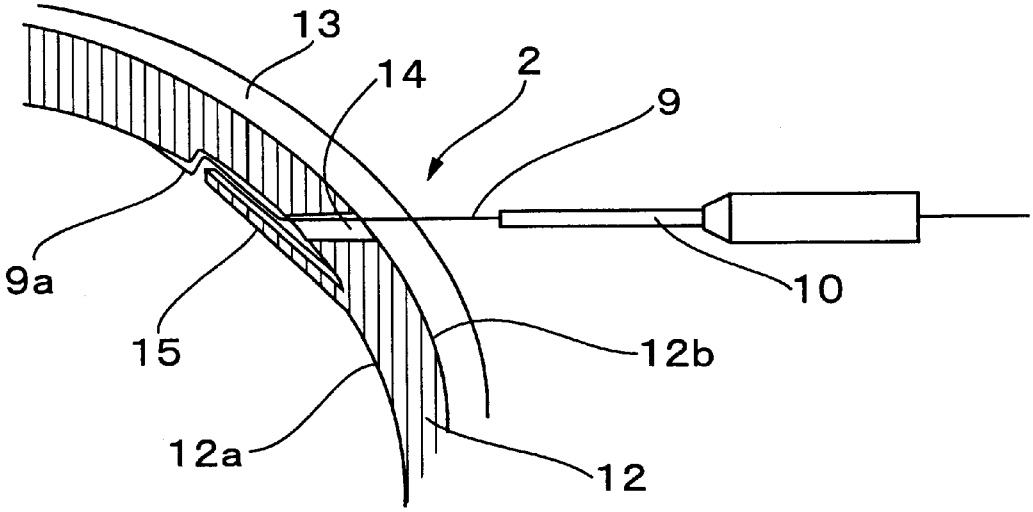

After the toroidal core 5 is being held by the core rotation mechanism 6, using the supply tube 10, wire 9 is drawn from the supply source 8 and the end of the wire 9 is fixed to the supply ring 2. This operation will now be described with reference to FIGS. 4, 5A and 5B. First, the supply ring 2 and winding ring 3 are rotated to line up the through-hole 14 of the supply ring 2 and the feed-out hole 23 of the winding ring 3. Then, the tube 10 is inserted into the through-hole 14 until the tip pushes out against the inside of the resilient member 15. In this state, the end 9*a* of the wire 9 is drawn out onto the inner surface 12*a* of the supply ring 2, and the tube 10 is withdrawn from the through-hole 14. This leaves the wire end 9*a* clamped by the resilient member 15.

Figure 6:
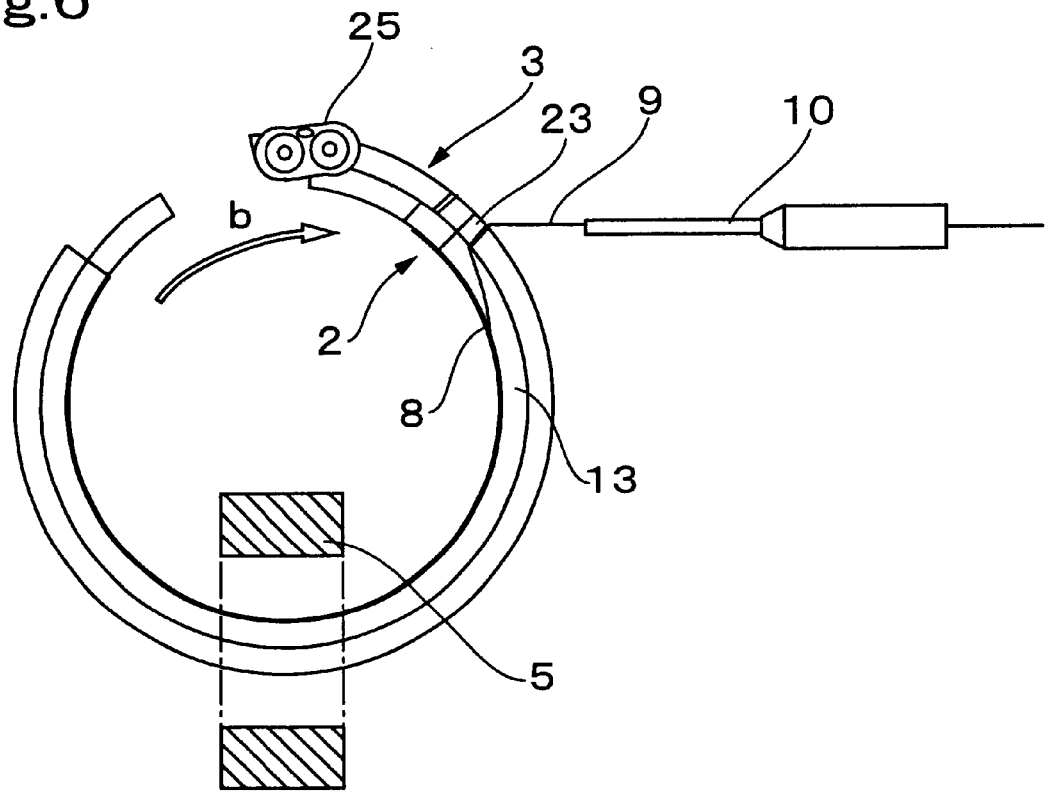
FIG. 6 shows the supply tube and wire after the wire has been fixed to the supply ring.

After the end of the wire 9 has been thus secured, the required amount of wire 9 is wound onto the groove 13 of the supply ring 2. For this, the ring rotation mechanism 4 rotates the supply ring drive rollers 31 in the direction indicated by the arrow b in FIG. 6. The L-shape of the through-hole 14 makes it difficult for the wire 9 to move readily through the through-hole 14, which enables the wire 9 to be wound on the supply ring 2 with no slack.

Figure 7:
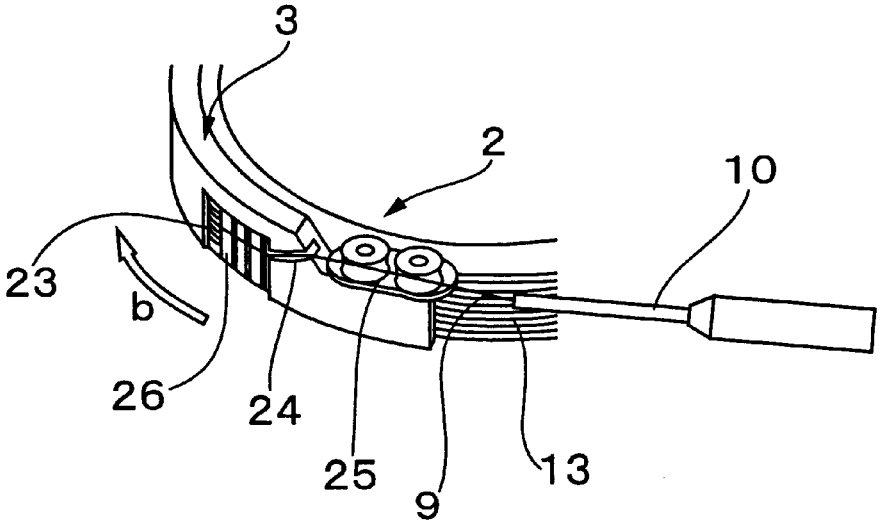
FIG. 7 is an enlarged perspective view of the wire feed-out parts attached to the winding ring.

After winding of the required amount of wire 9, the rotation of the supply ring 2 is stopped and the winding ring 3 is rotated in the same direction, as indicated by the arrow b in FIG. 7, as the wire 9 feeds out from the hole 23, along the groove 24 and through the wire guide 25 constituting a kink prevention means. The supply of wire 9 from the supply source 8 is then stopped.

Figure 8:
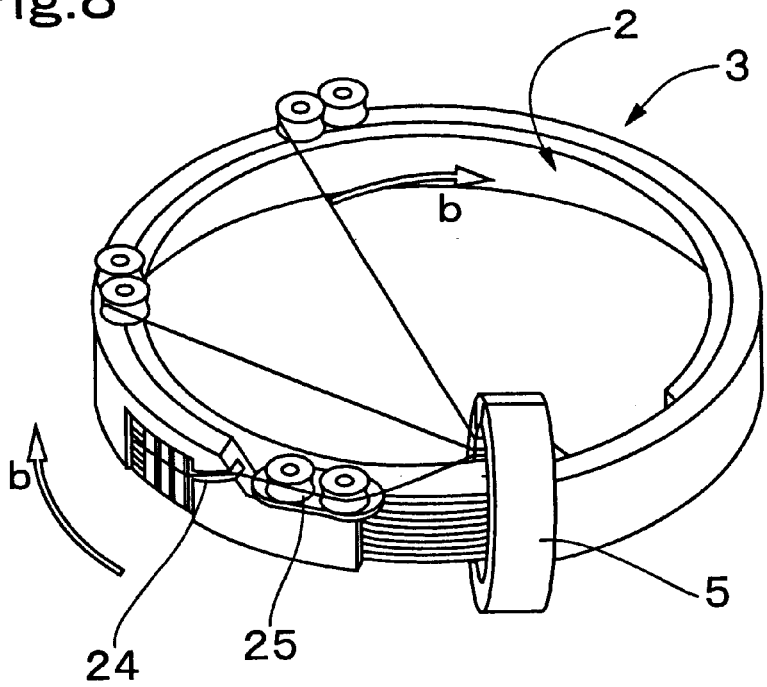
FIG. 8 is a perspective view showing the kink prevention means and the path of the wire during winding.
Figure 9:
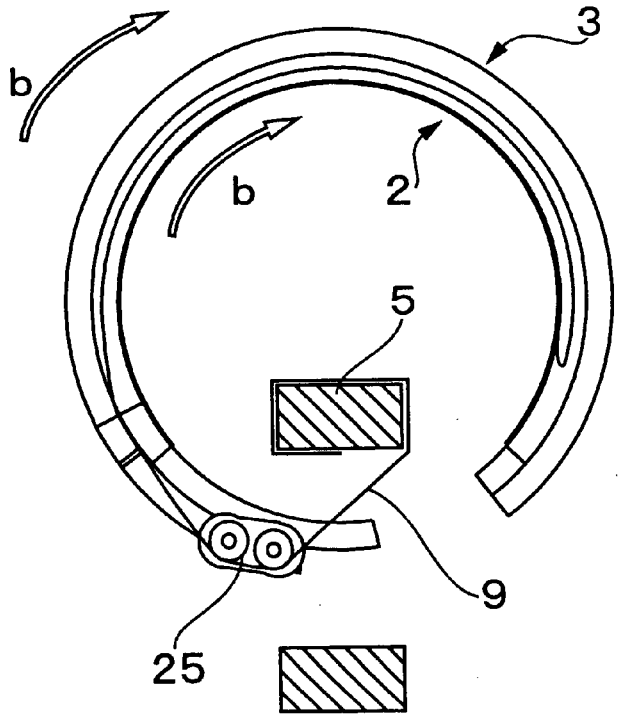
FIG. 9 shows the direction of rotation of the supply ring and winding ring and the run of the wire, during winding.

Next, the winding ring 3 and supply ring 2 are independently rotated in the same direction the supply ring 2 was rotated in to wind on the wire 9, indicated in FIGS. 8 and 9 by the arrow b. That is, the rings are rotated at a set differential speed. At the same time, the core rotation mechanism 6 rotates the toroidal core 5 about its axis 5*a* at a prescribed speed. This winds the wire 9 spirally onto the toroidal core 5.

If the winding ring 3 is rotated in the direction indicated in FIG. 9 by arrow b, it will unwind the wire 9 on the supply ring 2, producing slack. However, the supply ring 2 is rotated in the same direction in which the slack is taken up by the supply ring 2, making it possible to wind the toroidal core 5.

Figure 10:
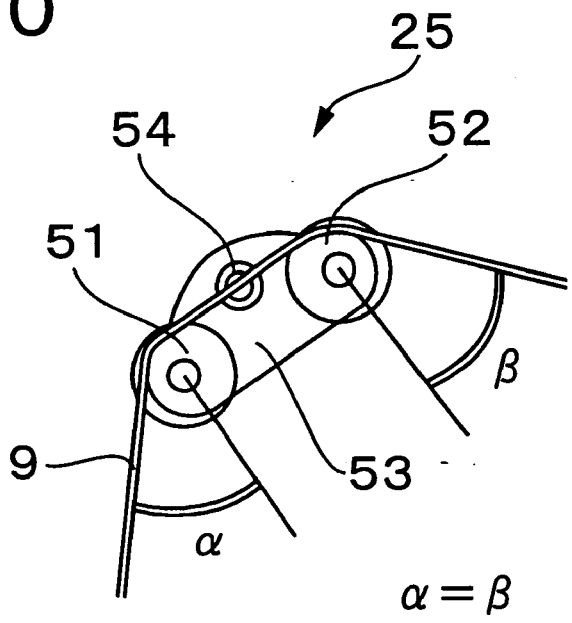
FIG. 10 is a plan view of an example of the kink prevention apparatus.
Figure 11:
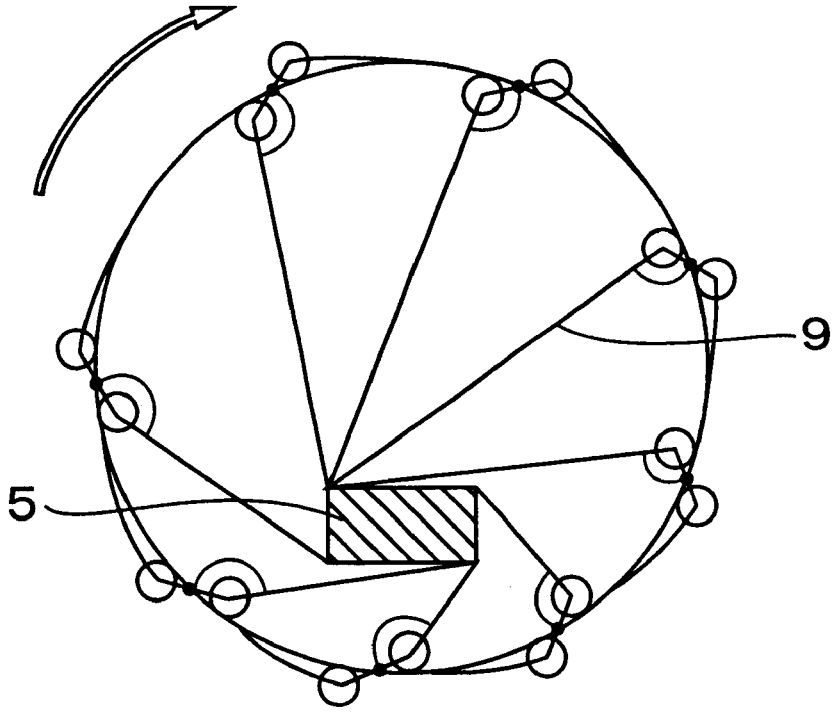
FIG. 11 illustrates the movement of the kink prevention means during each rotation of the winding ring, and the supplying of the wire.

As mentioned above, the wire guide 25 is a kink prevention means. As shown in FIG. 10, the kink prevention means has a support plate 53 that rotatably supports a pair of pulleys 51 and 52. The support plate 53 is rotatably attached to the edge 22*c* of the winding ring 3 by a shaft 54. When the pulleys 51 and 52 are subjected to the tension of the wire 9, the forces about the axis (the shaft 54) of the kink prevention means reach an equilibrium that gives rise to a constant angle ($\acute{a}=\hat{a}$) between the pulleys 51 and 52 and the wire 9. As a result, when wire is being wound onto the toroidal core 5, as shown in FIG. 11, the angles $\acute{a}$, $\hat{a}$ are never less than 90 degrees, keeping the wire free of kinks, which thereby improves the wire travel.

To ensure the wire 9 runs smoothly, the wire tension or the torque acting on the supply ring 2 can be measured and used as feedback for achieving a constant tension during the winding of the wire.

After several turns of wire are wound onto the toroidal core 5, so that the wire 9 is securely attached to the core 5, the wire 9 is cut, leaving enough of a length from the tip of the supply tube 10.

Figure 12:
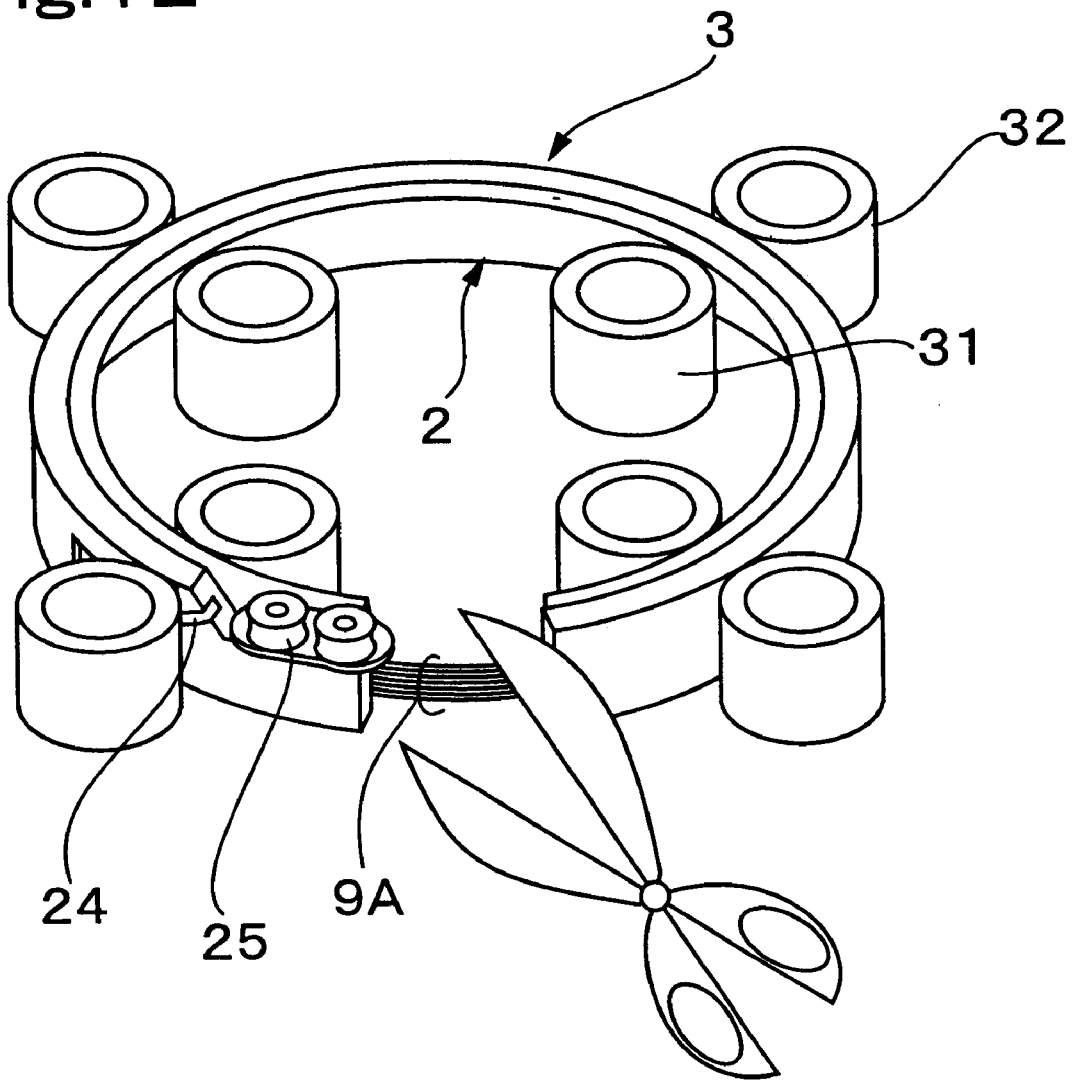
FIG. 12 is a perspective view of the removal of the wire.

If midway through the process the wire 9 breaks or becomes tangled, the slits 11 and 21 are lined up as shown in FIG. 12. This exposes the wire 9 wound onto the groove 13 of the supply ring 2, making it possible to remove the remaining wire by cutting through the bundle 9A at one go.

After finishing the winding of the wire onto the core 5, the wire 9 remaining on the supply ring 2 is cut and removed, as shown in FIG. 12. Then the toroidal core 5 on which the required amount of wire 9 has been wound, forming a toroidal coil, is removed from the rotation mechanism 6.

MODIFIED EXAMPLES

Figure 13A:
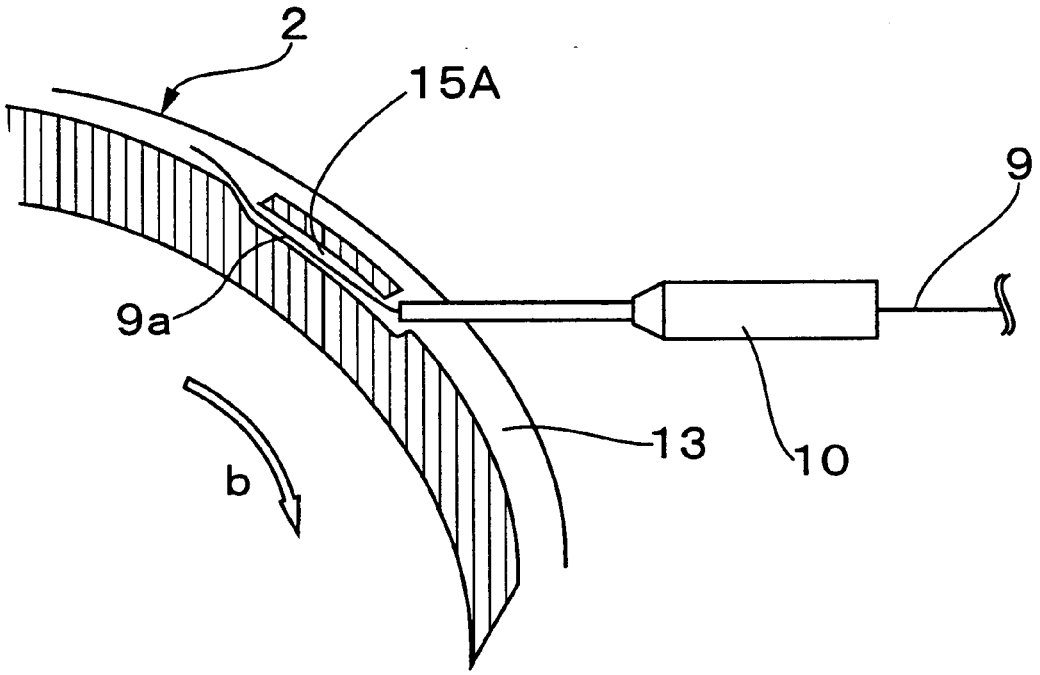
FIGS. 13A and 13B illustrate other mechanisms for fixing the wire.
Figure 13B:
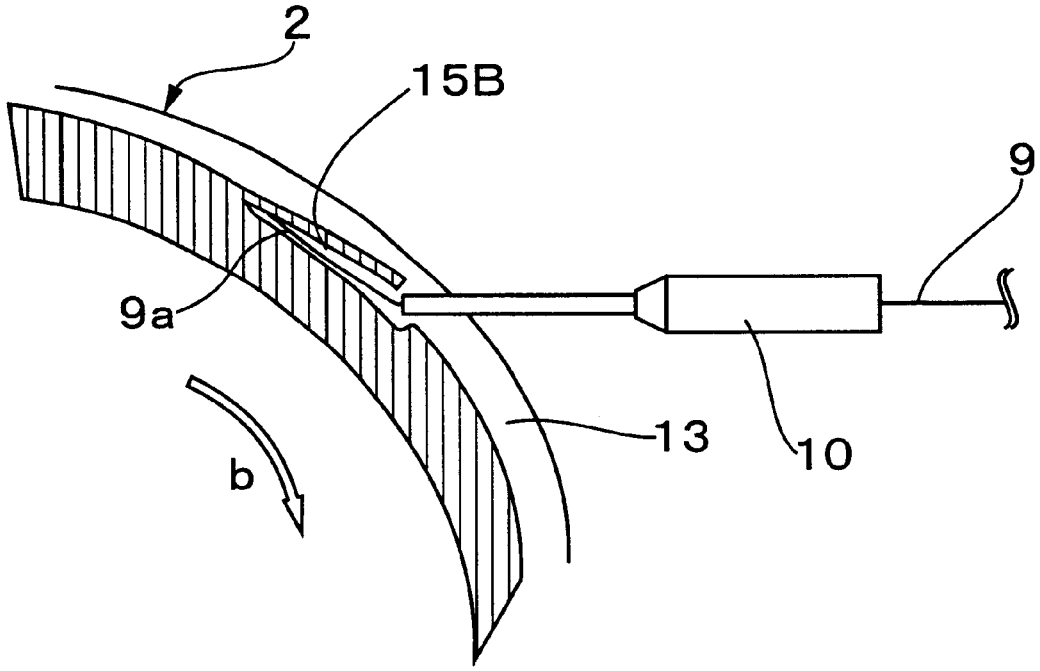

In the foregoing examples, a resilient member 15 is used to clamp the end 9*a* of the wire 9 to the supply ring 2. Instead of this, as shown in FIGS. 13A and 13B, a cylindrical through-hole 15A or blind hole 15B can be utilized.

Figure 14A:
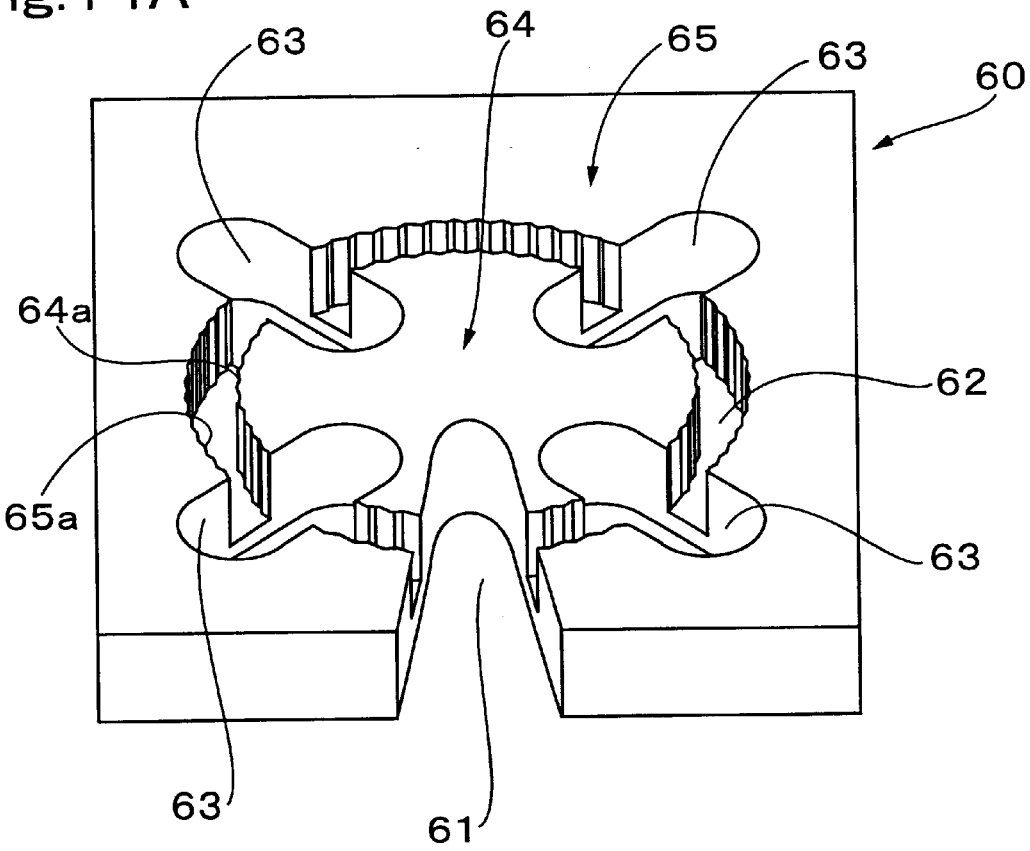
FIGS. 14A and 14B show an example of the automatic winding apparatus that includes a support frame.
Figure 14B:
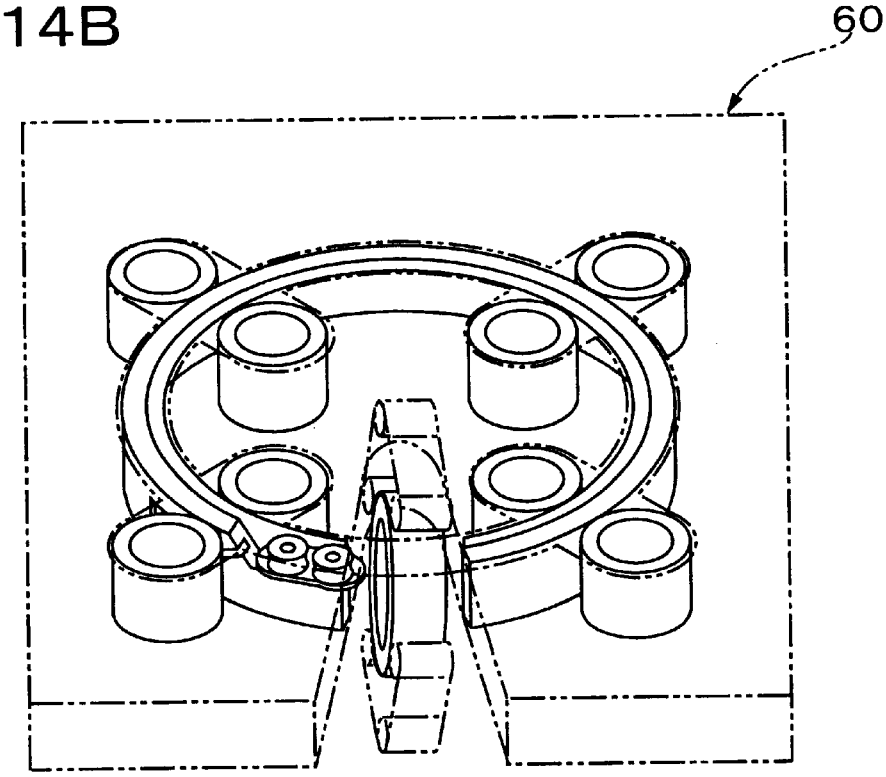
Figure 15:
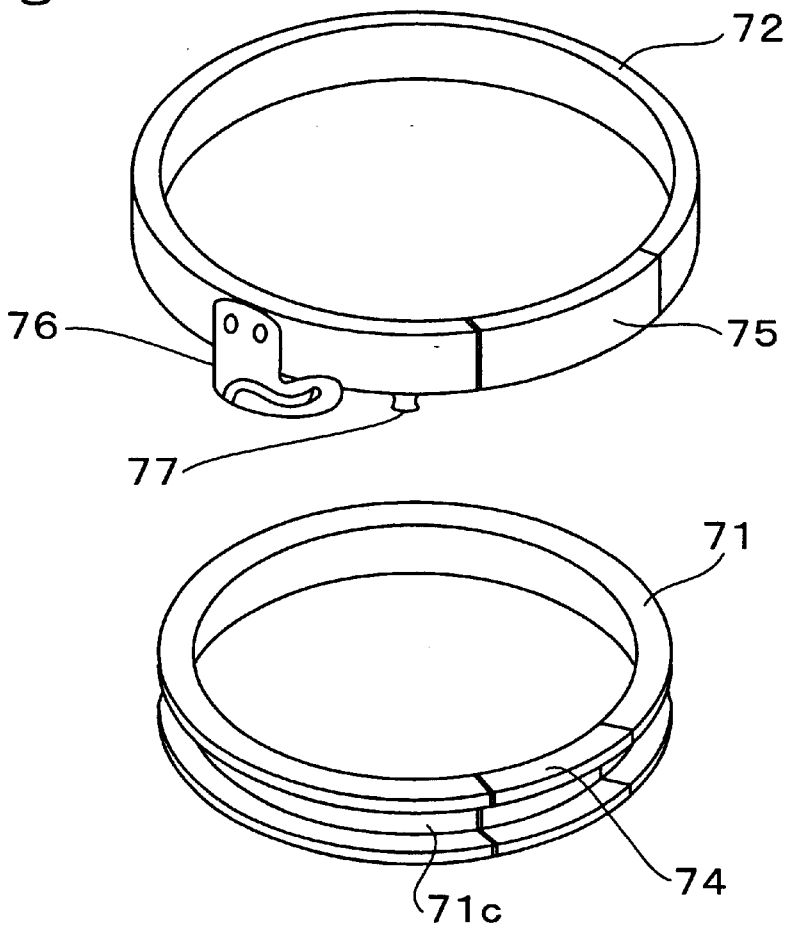
FIG. 15 is a disassembled perspective view of a prior art toroidal winder.
Figure 16:
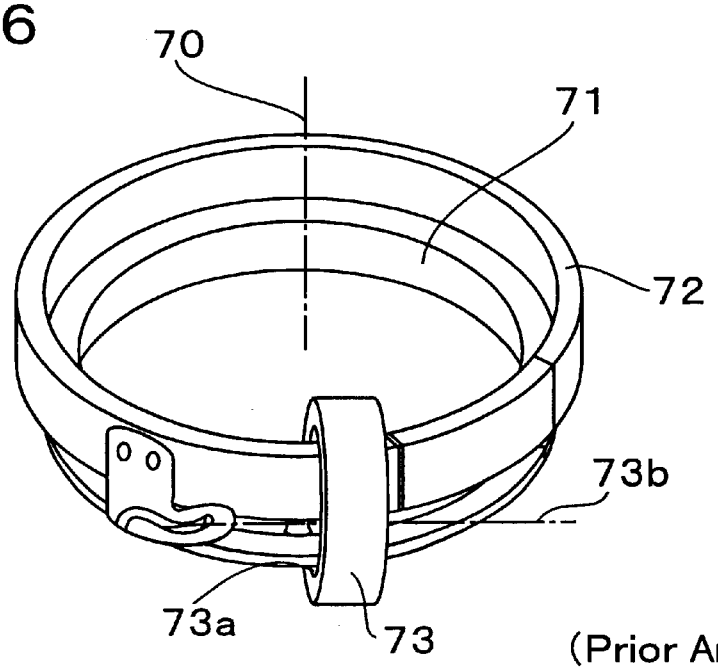
(Prior Art) Fig.16
FIG. 16 is a perspective view of a prior art toroidal winder.
Figure 17:
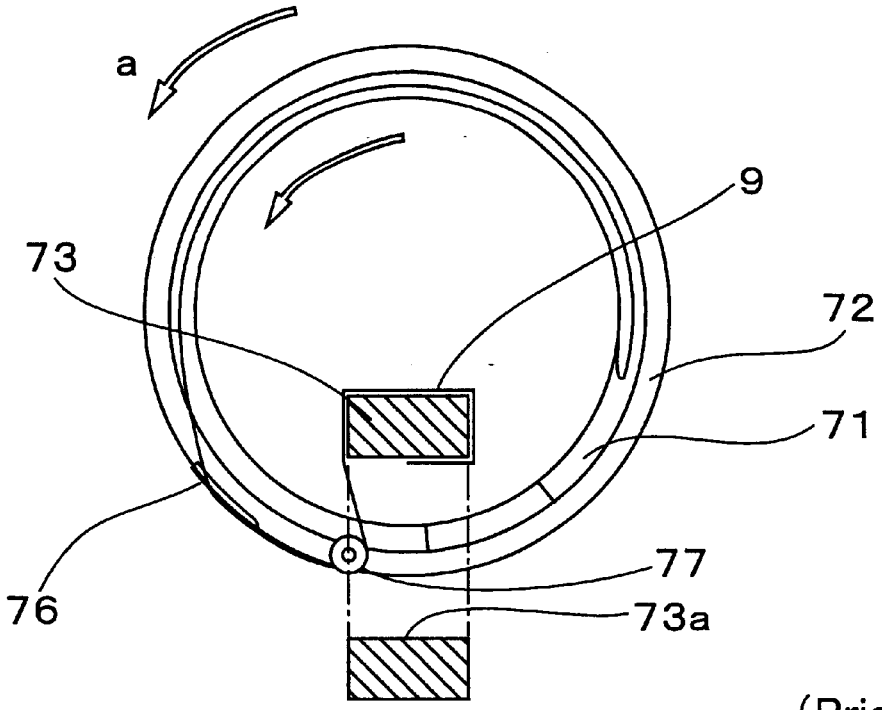
FIG. 17 shows the direction of rotation of the supply ring and winding ring and the run of the wire during winding using a prior art toroidal winder.
Figure 18:
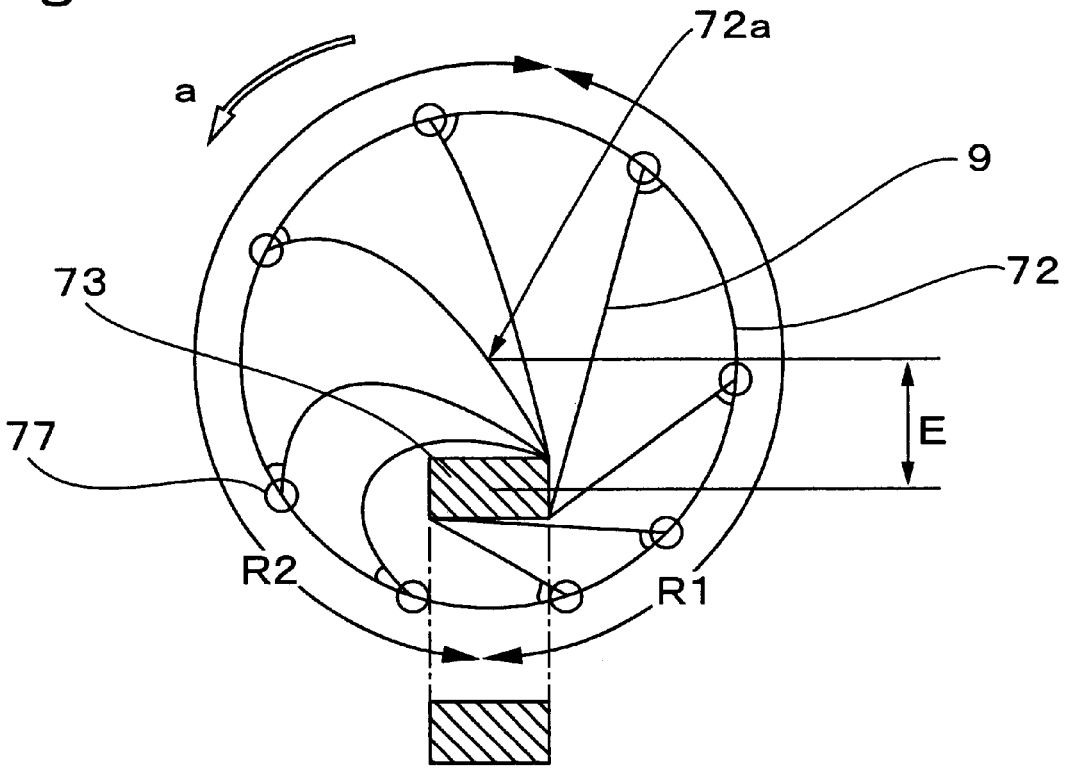
(Prior Art) Fig.18
FIG. 18 illustrates the supplying of the wire during each rotation of the winding ring of a prior art toroidal winder.

To prevent deformation of the slit rings 2 and 3, a support frame should be used such as the one shown in FIGS. 14A and 14B, to facilitate rotation by the ring rotation mechanism 4.

The support frame 60 shown in the drawings comprises a rectangular plate of a uniform thickness having a substantially triangular cutout portion 61 extending towards the center from one edge, and a circular cutout portion 62. Spaced at 90-degree intervals around the circumference of the cutout portion 62 are cutout portions 63 that extend radially. The cutout portion 61 is to accommodate the toroidal core 5, the cutout portion 62 is for the rings 2 and 3, and the four cutout portions 63 are for the drive rollers 31 and 32.

The cutout portion 62 divides the support frame 60 into an inner support frame 64 and an outer support frame 65. The peripheral surface 64*a* of the inner support frame 64 is a smooth surface for slidably supporting the inner surface 12*a* of the supply ring 2. It can be formed as a ridged surface having a small contact area, or as a surface with needle bearings. The inner surface 65*a* of the outer support frame 65 is also a smooth surface that slidably supports the outer surface 22*b* of the winding ring 3. This surface too can be formed as a ridged surface having a small contact area or as a surface with needle bearings.

As a way of precisely maintaining the tension acting on the wire being wound onto the toroidal core, a tension sensor 26 can be provided between the feed-out hole 23 and feed-out groove 24 of the winding ring 3, as shown in FIG. 7, so that the wire 9 being drawn out passes the tension sensor 26. The output from the tension sensor 26 can be used as feedback to enable the control unit 7 to control the ring rotation mechanism 4 to maintain a constant wire tension.

It is also preferable to be able to measure the load torque acting on the supply ring drive rollers 31 by providing a torque sensor 27 and using the output from the sensor 27 as feedback to be used by the control unit 7 for controlling the ring rotation mechanism 4 to maintain a constant wire tension.

As described in the foregoing, with the toroidal core winding method and automatic winding apparatus of this invention, during winding a motor or the like is used to rotate the supply ring and winding ring in the same direction as the supply ring is rotated to wind on the wire to be used. The supply ring and winding ring are rotated at different speeds, and the length of the wire wound onto the toroidal core corresponds to the difference in the amount of rotation between the supply ring and winding ring. This enables the wire to be wound at a constant tension, with no slack.

The supply and winding rings are each cut through at one point, making them C-rings. Aligning the cut portions enables cores to be mounted and demounted, and facilitates removal of wire remaining on the supply ring after the winding is completed, or when the wire breaks or becomes tangled. This makes it possible to automate winding processes that in the prior art have had to be done manually.

Moreover, the use of a kink prevention means greatly reduces the load on the wire, and also makes it possible to maintain the wire at a constant tension as it is wound on the toroidal core, which has hitherto been difficult to accomplish. This also enhances the precision of the winding.

Also, the winding ring is located on the outside of the supply ring, so the winding groove of the supply ring is covered by the winding ring, preventing the wire coming off the supply ring during wire loading or winding operations.

Also, possible deformation of the supply ring or winding ring is suppressed by using a support frame.

The toroidal core can be securely held and rotated by the belt and pulley configuration of the core rotation mechanism.

The apparatus includes a resilient member to ensure the wire is securely clamped.

In addition, when a tension sensor is used to detect the tension acting on the wire, or a torque sensor is used to detect the load torque on the supply ring drive rollers, the detection outputs can be used as feedback to effect more precise control for maintaining the wire at a constant tension.

What is claimed is:

1. A method of winding a toroidal core, comprising:

arranging a toroidal core on a wire supply ring and a winding ring that are concentrically arranged, with the supply ring and winding ring passing through a central hole of the toroidal core;

taking an end of a wire wound circumferentially around an outer peripheral surface of the supply ring and drawing the end of the wire through a wire guide attached to the winding ring;

rotating the supply ring and winding ring around central axes of the rings in a same direction as that in which the supply ring was rotated when being loaded with the wire, at mutually different speeds; and, rotating the toroidal core about its central axis simultaneously with the rotation of the supply ring and winding ring; whereby spirally winding the toroidal core with a length of the wire that corresponds to the difference in rotation amounts of the supply ring and winding ring.

2. An automatic winding apparatus for automatically winding a toroidal core, comprising:

a supply ring on a peripheral surface of which wire is circumferentially wound;

a winding ring having a wire guide for drawing the wire from the supply ring;

a toroidal core rotation means that supports the toroidal core so that the supply ring and winding ring pass through a central hole of the toroidal core and also rotates the toroidal core about its central axis; and, a ring rotation means that rotates the supply ring and winding ring around the rings' central axes in a same direction as that in which the supply ring was rotated when being loaded with the wire, at mutually different speeds; whereby the difference in rotation amounts of the supply ring and winding ring becomes length of wire that is wound on the toroidal core.

3. The apparatus according to claim 2, wherein the supply ring and winding ring are each formed as a C-shaped ring by a slit of a prescribed width formed through a point on the periphery of each ring.

4. The apparatus according to claim 2, wherein the supply ring is disposed concentrically with the winding ring with the supply ring on a radially inner side of the winding ring.

5. The apparatus according to claim 4, further including an outer support frame that slidably supports the winding ring so that the outer peripheral surface of the winding ring is free to slide circumferentially.

6. The apparatus according to claim 4, further including an inner support frame that slidably supports the supply ring so that the inner peripheral surface of the ring is free to slide circumferentially.

7. The apparatus according to claim 4, wherein winding ring further includes a wire feed-out hole that runs therethrough from inside to outside, a wire feed-out groove that extends from an outside edge of the wire feed-out hole to an edge of the winding ring, and the guide roller located adjacent to the wire feed-out groove.

8. The apparatus according to claim 7, wherein a tension sensor is provided at the wire feed-out hole that detects tension of a wire being pulled from the supply ring through the wire feed-out hole and along the feed-out groove.

9. The apparatus according to claim 8 that further control means that uses output from the tension sensor as a basis for controlling the ring rotation means to maintain a constant wire tension.

10. The apparatus according to claim 2, wherein the supply ring includes a wire holding portion on a periphery of the supply ring to hold an end of a wire that is being wound onto the supply ring, the wire holding portion including a resilient strip the resiliency of which is utilized to clamp the end of the wire.

11. The apparatus according to claim 2, wherein the ring rotation means includes a plurality of winding ring drive rollers and a plurality of supply ring drive rollers, the winding ring drive rollers being spaced at equal intervals around the winding ring in contact with the outer peripheral surface of the ring in a circle that is concentric with the winding ring, and the supply ring drive rollers are spaced at equal intervals around the supply ring in contact with the outer peripheral surface of the ring in a circle that is concentric with the ring.

12. The apparatus according to claim 11, further including a torque sensor that measures load torque acting on supply ring drive rollers, and a control means that uses output from the torque sensor as a basis for controlling the differential rotation drive to maintain a constant load torque.

13. The apparatus according to claim 2, wherein the wire guide is a kink prevention means that utilizes force balancing based on the wire tension.

14. The apparatus according to claim 13, wherein the kink prevention means comprises a pair of guide rollers and a support plate that rotatably supports the guide rollers and is rotatably attached to an edge surface of the winding ring, with centers of rotation of the guide rollers and support plate being parallel to an axis of rotation of the winding ring.

15. The apparatus according to claim 2, wherein the toroidal core rotation means includes at least two drive units, each drive unit has at least three rollers and a drive belt on the rollers, the toroidal core being held by a prescribed force between the drive belts of the drive units, in which state the toroidal core is rotated by the drive belts.

* * * * *